US005150510A

United States Patent [19]

Moreland

[11] Patent Number: 5,150,510

[45] Date of Patent: Sep. 29, 1992

[54] METHOD OF MANUFACTURING LARGE SCALE MEMBRANES FOR COVERING EXTREMELY LARGE AREAS

[75] Inventor: Jack Moreland, Dolton, Ill.

[73] Assignee: MPC Containment Systems, Ltd., Chicago, Ill.

[21] Appl. No.: 634,418

[22] Filed: Dec. 27, 1990

Related U.S. Application Data

[63] Continuation of Ser. No. 886,917, Jul. 16, 1986, Pat. No. 4,987,657, which is a continuation of Ser. No. 523,657, Aug. 15, 1983, Pat. No. 4,641,400.

[51] Int. Cl.[5] ..... B23P 11/02

[52] U.S. Cl. ..... 29/525.1; 79/897.32

[58] Field of Search ..... 29/525.1, 897.32; 24/389, 432, 39, 34, 31 W, 33 R, 33 A, 33 B, 33 C, 33 K, 33 M; 135/119; 173/27; 4/498, 503; 52/63

[56] References Cited

U.S. PATENT DOCUMENTS

| | | | |
|---|---|---|---|
| 1,792,669 | 2/1931 | Wickstrum | 135/119 X |
| 2,066,974 | 1/1937 | Hindle et al. | 24/33 K |
| 2,493,833 | 1/1950 | Reynolds | 135/119 X |
| 2,540,380 | 2/1951 | Schultheis | 273/27 |
| 2,604,897 | 7/1952 | Cottor et al. | 135/119 |
| 2,637,086 | 5/1953 | Philips | 24/389 X |
| 2,923,305 | 2/1960 | Cline | 135/119 X |
| 3,324,516 | 6/1967 | Dorr et al. | 24/33 C |
| 3,417,406 | 12/1968 | Rosenbaum | 24/389 X |
| 3,503,101 | 3/1970 | Kolozsvary | 135/119 X |
| 3,564,284 | 2/1971 | Mollinger | 52/63 |
| 3,762,108 | 10/1973 | Pierson | 52/63 X |
| 3,795,830 | 6/1974 | Leatherman | 135/119 X |

*Primary Examiner*—Timothy V. Eley
*Attorney, Agent, or Firm*—Laff, Whitesel, Conte & Saret

[57] ABSTRACT

A mechanically strong, airtight, watertight seam provides for joining two panels of industrial strength fabric or material. The inventive seam has two connection systems. One system is a mechanically strong structural connection which is used to make the seam as strong as the fabric panel material. A second system is an all plastic slide closure in the form of a zipper connection which overlies the structural connection, joins the panels into a single cover, and makes the seam airtight, watertight and maintenance free.

6 Claims, 3 Drawing Sheets

METHOD OF MANUFACTURING LARGE SCALE MEMBRANES FOR COVERING EXTREMELY LARGE AREAS

This application is a continuation of Ser. No. 06/886,917 filed Jul. 16, 1986, now U.S. Pat. No. 4,987,657, which is a continuation of U.S. Ser. No. 06/523,657 filed Aug. 15, 1983, now U.S. Pat. No. 4,641,400.

The invention relates to airtight, watertight, mechanically strong seams, which may be used to make structural connections, especially between panels of industrial strength fabric or material. More particularly the invention relates to seams for industrial strength fabric, which seams can be made in the field at the time of installation of the fabric, with few or no special tools.

BACKGROUND OF THE INVENTION

Industrial strength fabrics and materials have many outdoors applications, such as covers for football or baseball fields, covers for tennis courts, walls or fences, and liners and covers for ponds and reservoirs. Since these industrial fabrics are often used to cover or line large surface areas, several panels of fabric may have to be joined together in order to facilitate installation. Therefore, a seaming or welding together of the fabric panels is often done at the site location, as the liner or cover is installed.

When the panels of fabric are to be used under stress conditions such as outdoors, in high winds and rain, for example, the strength of the fabric liner or cover is dependent on the weakest seam. If panels of a class of industrial fabrics known as liquid impervious, flexible membranes are used to line or cover ponds or reservoirs, for example, various environmental conditions such as pond irregularities, settling and cracking, high winds, rain and ice may cause the fabric to split, especially at its weakest seam. Therefore, it is necessary to provide not only air and watertightness, but also a structurally strong and sound mechanical seam for joining panels of industrial fabric.

In the installation of industrial fabric liners or covers, there are also other considerations, such as the contours of the surface to be lined or covered. For example, it may be desirable to cover a flat football or baseball field with a watertight cover having seams lying flat on the ground so that water will not collect between panels of the cover when it rains. Other examples are liners for basin-shaped, waste-holding ponds or pits, in which basin-shaped liners might be used to contain seepage of waste products from the pond or pit into the soil, where watertight seams are essentially underwater. Airtight seams might be necessary if industrial fabric covers are used to cover and trap gas over fermentation piles or collection ponds. Thus, there should be a versatility in seam formation so that any of many different configurations may be accommodated.

Present seams or welds, which provide both strength and watertightness and which are made in the field, normally require adhesives or gum tape. For thermoplastic fabrics, hand-held portable heat welders may also be used. The problem with seaming or welding fabric panels together with adhesives or gum tape is that these methods are time-consuming and may be unreliable depending on the skills of the installer. The quality of these seams may also be dependent on temperature or weather conditions. These seams cannot always be made in extremely hot, cold or wet weather. Also adhesive seams require curing and drying time before a good bond strength is developed and the seams are sufficient for testing and use. Thus, with conventional techniques, it may not be possible to install a liner quickly enough to contain water leaking through an earthen dam, for example.

For thermoplastic fabrics, the hand-held heat welding method for making seams has advantages over adhesive seams. However, it cannot be used with non-thermoplastic industrial fabrics. Thus, if thermoplastic fabric is not the fabric of choice for a particular job, this method is not available.

DESCRIPTION OF THE INVENTION

An objective of the invention is to provide airtight, watertight, mechanically strong seams which are as strong as or stronger than the fabric with which they are used. Another object is to provide seams which are airtight, watertight, maintenance free, and which are made easily and effectively in the field in almost any ambient temperature and weather conditions.

Yet another objective of the invention is to enable a seaming together of panels of industrial fabrics in the field by a few workers and in a short period of time. A further objective is to enable standardized seams to be made in a factory and installed in the field, which seams are not normally subject to variations in quality, or dependent upon the person or persons making the seams.

According to an aspect of the invention, a mechanical seam joins two or more panels of industrial fabric. The seam provides two forms of connections between the panels, one for giving mechanical strength and the other for providing airtightness and watertightness. The connection which provides mechanical strength includes a structural connection between cables extending along and embedded in the edges of the panels. The connection also includes links, shackles, ties, staples or the like for interconnecting two parallel cables and/or a series of catenary cables of adjoining panels. The connection which provides airtightness and watertightness are panel flaps attached near and running along the connected edges of the panels. The panel flaps have a slide closure means (sometimes called "Plastic Zippers") for sealing the flaps, and making the connection between the panels watertight and airtight.

The invention will best be understood by reference to the following description and the attached drawings, in which.

Figure 1:
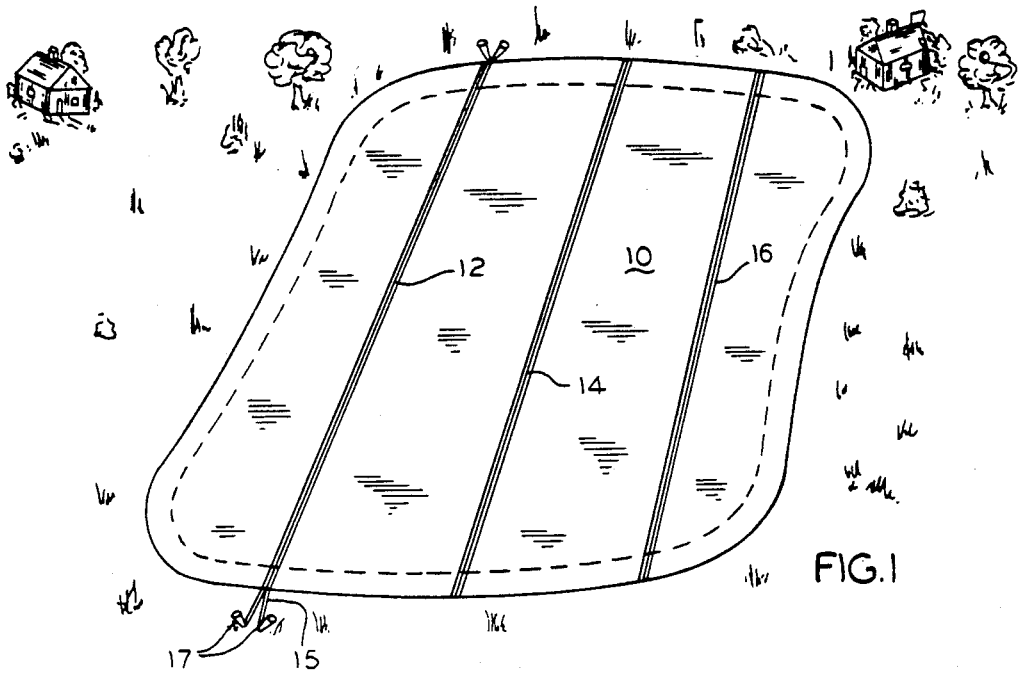
FIG. 1 is a perspective view of a cover for a pond with panels which are seamed together in the inventive manner.

FIG. 1 shows a cover 10 made of four industrial strength fabric panels, joined together at seams 12, 14, 16, and placed over the surface of a pond in order to prevent evaporation or contamination of the water by dust o other potential pollutants. Fabrics used for this type of cover might include those manufactured from synthetic rubber and reinforced with fabric as made by E.I. duPont De NeMours & Co. such as "Hypalon" or "Neoprene".

If the area to be covered is very large, a number of panels of the cover material may be made to order in a factory and delivered to the installation site, where they are joined together by the inventive seams 12, 14, 16. Sometimes, it is desirable for the seams to include cables 15 which may be secured in place (as by stakes 17) to provide anchor means in order to help support the weight of the cover resting on the surface of the pond. These cables are parallel when the load acts perpendicular to the membrane. In large-sized cover applications where high membrane stress loads are developed, the cables are arranged in a series of catenary arches to uniformly distribute the membrane stress loads.

In the past, completing these seams in the field has required many man-hours. If an adhesive is used, the weather conditions may prevent or slow the field-seaming. Also, previous seams may or may not be of the same quality as factory-made seams because they are not subject to the same quality control.

Figure 2:
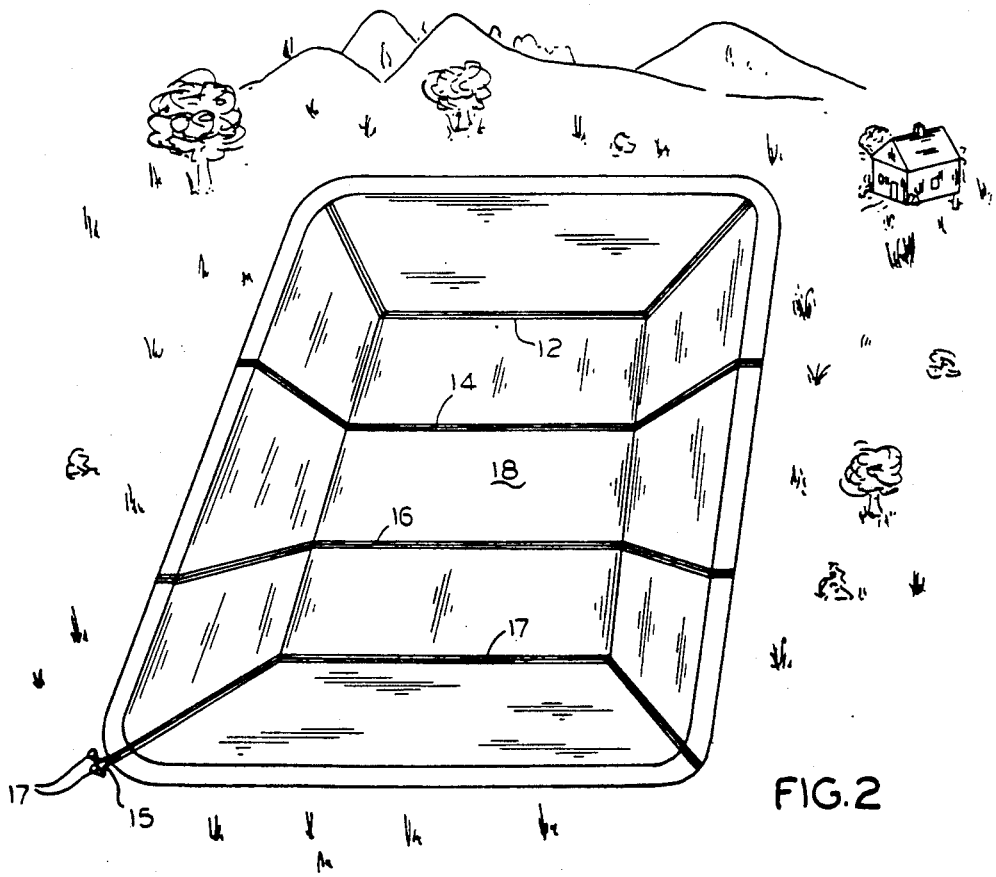
FIG. 2 is a perspective view of a basin-shaped liner for a pit or reservoir with panels which are seamed together.

In FIG. 2, a basin-shaped liner 18 is suitable for a pit or reservoir which holds materials such as chemicals or other pollutants. The liner is placed in the bottom of the pit or reservoir to keep the chemicals or pollutants from leaching into the surrounding soil. As with the cover 10 of FIG. 1, the liner 18 covers a large surface area and has a number of panels which are seamed together at 12, 14 16, 17, upon installation. Again, it may be desirable to attach to the earth, cables 15 extending through the seams, as by stakes 17.

The cover 10 and the liner 18 require seams which are at least as strong and durable as the cover or liner panel materials. Strong seams enable the cover or liner to hold up under severe stress such as winds, currents and thermal movement. These seams should also be watertight to prevent rain from penetrating the cover 10 or to stop pollutants from entering the soil through the liner 18.

Figure 3:
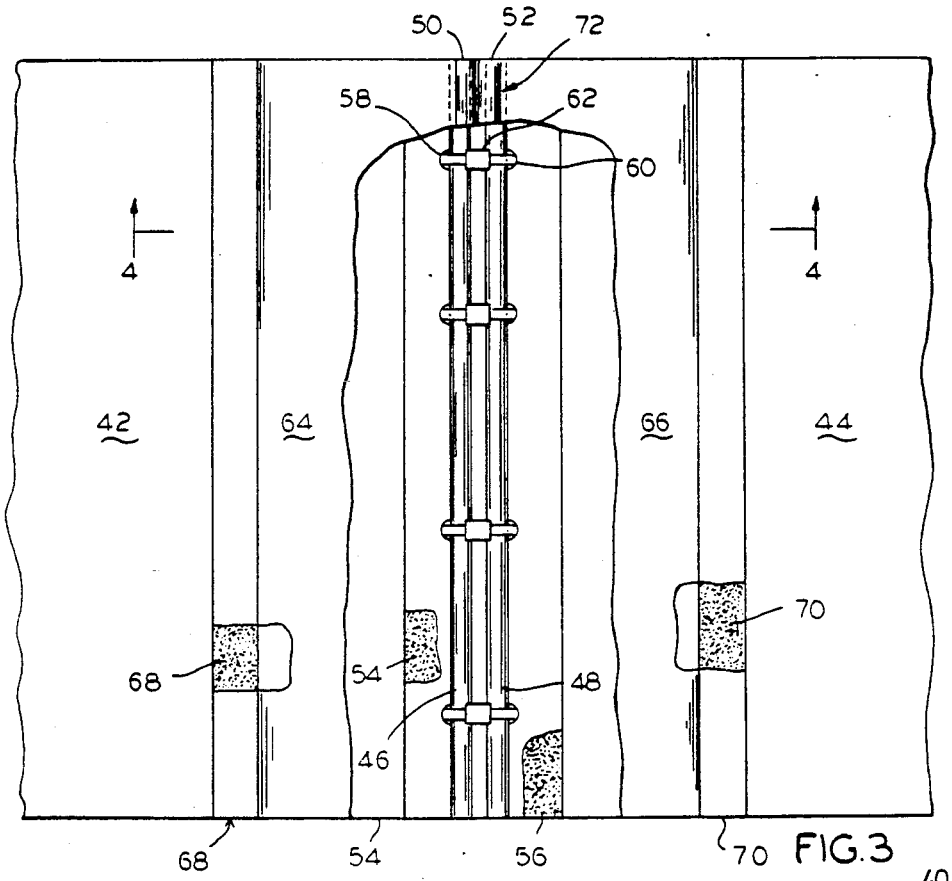
FIG. 3 is a top plan view of the inventive seam with watertight panel flaps cut away and with parellel cables to withstand loading perpendicular to the membrane.
Figure 4A:
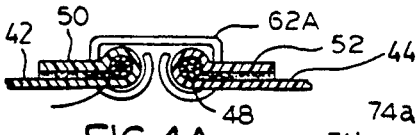
FIG. 4A shows a fragment of FIG. 4 with a staple used as a mechanical connector to join the two panels.
Figure 4B:
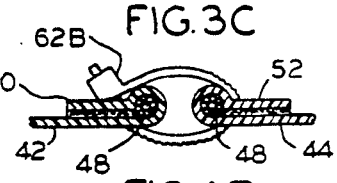
FIG. 4B shows a fragment of FIG. 4 with a cable tie used as a mechanical connector to join two panels. watertight flaps
Figure 4:
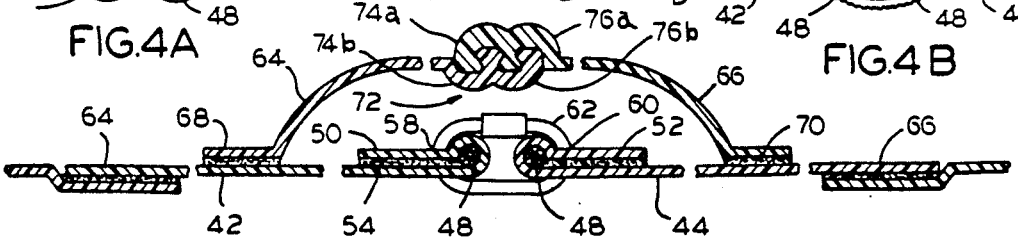
FIG. 4 is a side elevational, cross-sectional view taken along line 4—4 of FIG. 3, showing the inventive airtight, watertight flaps joined in a mechanical seam.

As shown in FIGS. 3 and 4, the inventive airtight, watertight mechanical seam solves the problems presented by previous field seaming techniques. Two panels 42, 44 can be seamed together quickly and easily at any convenient site of installation to provide a sturdy, mechanically strong, airtight and watertight seam. The glued seams or welds 68, 70 are made in a factory so that this seaming method is not subject to variations caused by field conditions or operator error.

Figure 3A:
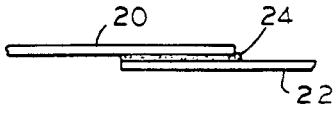
FIGS. 3A–3C show conventional seams which may be made in a factory during construction of the individual panels.
Figure 3B:
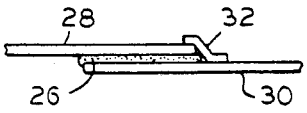
Figure 3C:
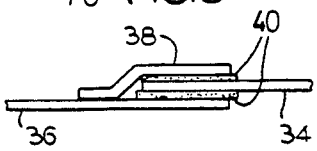

For example, as shown in FIGS. 3A, 3B, and 3C, the factory made seams 68, 70 employ the prior art method and are made with adhesives or gum tape. One example of such an adhesive seam (FIG. 3A) is to overlap two fabric panels 20, 22 by about six inches and then add an adhesive 24 in the overlapping areas. Another example of a seaming technique (FIG. 3B) is to use a double-sided gum tape 26 in the overlapping area of two panels 28, 30. To reinforce the edge, another piece of gum tape 32 is placed over an edge of the seam. A third seaming method (FIG. 3C) uses a tongue and groove method where a six-inch (for example) panel 38 is attached and vulcanized to the panel 36 in the factory, forming a groove for insertion of the panel 34. The panel 34 is adhered to and between panels 36, 38 by any suitable means 40. Heat welding and other seaming methods may also be done in the factory for these seams.

In FIGS. 3 and 4, panels 42, 44 have cables 46, 48 attached to and running along the adjoining edges of the panels. These cables may or may not extend beyond the ends of the panels to provide the anchoring cables 15 of FIGS. 1 and 2. Preferably, the cables are one-quarter inch, stainless steel stranded cables. In the preferred embodiment, these cables 46, 48 are enclosed by the edges of the panels which are folded over and welded in the factory, thus enclosing and embedding the cables in folds 50, 52. These folds are made by folding approximately two to five inches of fabric over the cables 46, 48 and welding the folded fabric to the panels 42, 44 at welds 54, 56.

The cables may be coated with a suitable water-resistant material, such as PVC, before the cables are attached to the panels. The cable of choice may vary depending on the desired strength and intended use of the liner or cover.

Apertures 58, 60 are made in cover panels 42, 44, along the welds 54, 56, and adjacent the cables 46, 48. The cables 46, 48 are then connected together by any suitable loop connector means 62, thus forming a mechanically strong structural seam between panels 42, 44. A plurality of the connector means 62 are placed through the apertures 58, 60 and are looped and locked around the cables 46, 48 at distributed locations along the length of the panels. The connector means 62 can be any suitable device such as links, shackles, staples 62A, cable ties 62B or the like. Preferably, they are made of stainless steel, which can be coated in a water-resistant PVC.

In addition to the mechanically strong structural cable and loop connection of the panels 42, 44 described above, a water and airtight connection is also provided. This connection of the panels comprises panel flaps 64, 66 attached near the adjoining edges of panels 42, 44. In the preferred embodiment the panel flaps 64, 66 are welded to the panels 42, 44 in the factory, at welds 68, 70, constructed by any suitable factory seam, such as those shown in FIGS. 3A-3C.

The confronting edges of the panel flaps 64, 66 are sealed together by means of a slide closure 72 (FIG. 4). Any suitable slide closure means can be used which provides watertightness and airtightness and which is easy to open or close in any weather or under any environmental conditions. It is also desirable to use a slide closure which is maintenance free.

One example shown in FIGS. 3, 4 is a sectionalizing plastic zipper which provides for a quick and easy closure by using a simple hand held roller tool. The zipper 72 or slide fastener comprises a pair of continuous beads 74*a*, 76*a*, 74*b*, 76*b* of interlocking plastic channels formed along each confronting edge of the two panel flaps 64, 66. These beads comprise confronting coves 74*a*, 76*a* on one flap 66, which receive upstanding and complementary contoured beads 74*b*, 76*b* on the other flap 64. The two complementary members 74*a*, 76*a*, 74*b*, 76*b* are forced to spread apart to receive each other and then, responsive to plastic memory, to come together, embrace and hold each other in a tight fit. One advantage to this type of zipper is that it is relatively maintenance free. In a conventional zipper, sand or dirt can collect in the teeth. In the preferred sectionalizing plastic zipper sand, dirt or debris cannot collect between the beads.

Another characteristic of this type of zipper is that it is almost impossible to pull the two mating zipper halves apart by forces exerted in the directions of the arrows A-B. However, the zipper easily separates responsive to forces in the directions of the arrows C, D. To forestall such separation, the two cables 46, 48 are secured together by the mechanical connectors 62.

FIGS. 3 and 4 show a design for the seam which has parallel cables which take loading stresses applied perpendicular to the cover material. Thus, for example, if the cover is on a lake, and if it must contain and support the weight of rain water on its surface, parallel cables such as 46, 48 shown in FIGS. 3 and 4 are used.

Another kind of stress occurs when all stress factors are in the plane of the cover or membrane itself. For example, if a cover is laid down on a football field and then the cover is pulled into place, there is no appreciable vertical load, since the earth itself is supporting the weight of the cover. On the other hand, there is a substantial stress within the membrane itself, which is caused by dragging or pulling the cover across the surface of the earth. In this case, the catenary cable embodiment of FIG. 5 is used.

Figure 5:
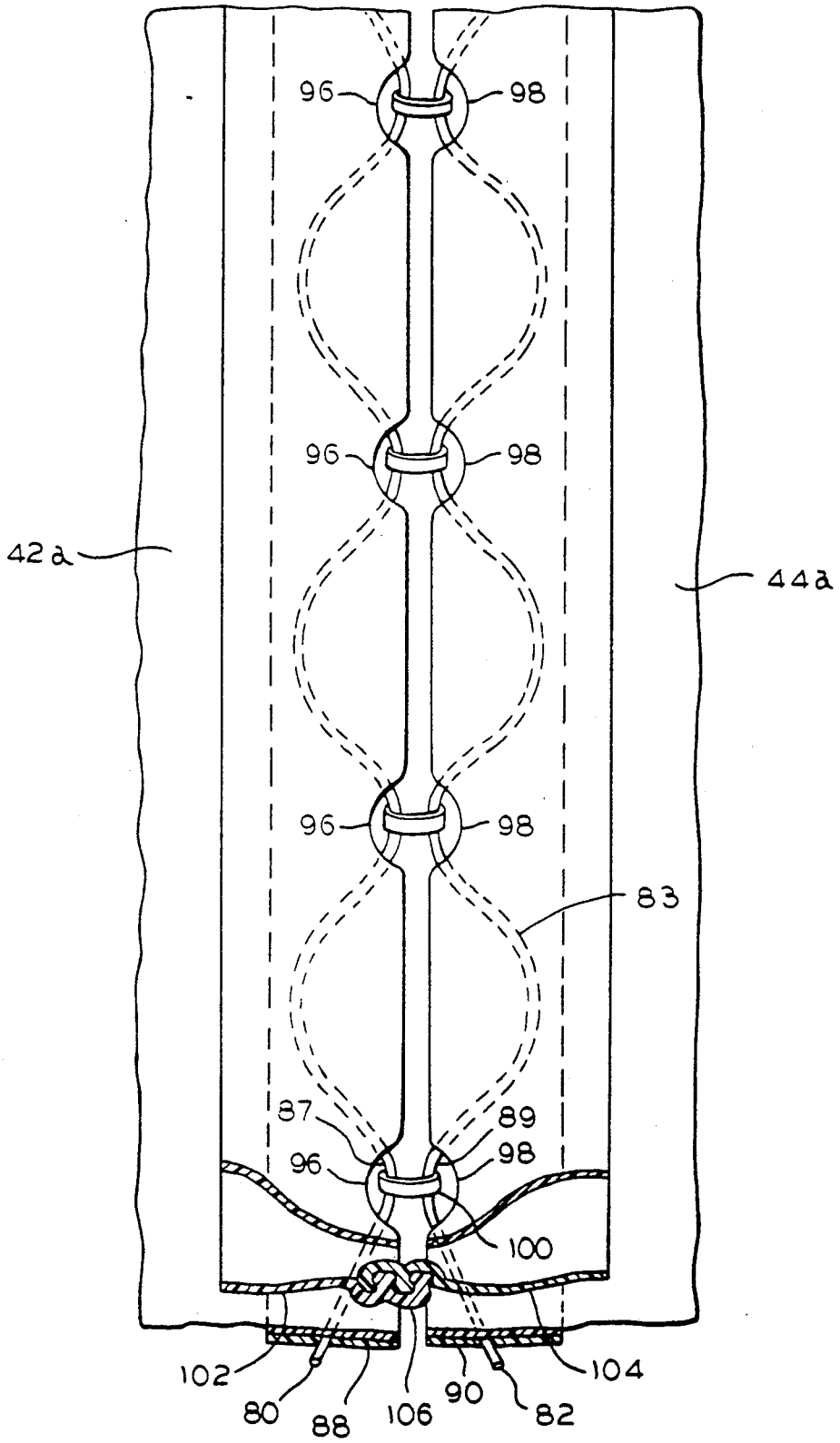
FIG. 5 is a top plan view of the inventive seam, similar to FIG. 3, with catenary cables to withstand loading in the membrane itself.

FIG. 5 shows catenary cables 80. 82, which form arches as at 83, for example, along the edges of the cover panels 42*a*, 44*a*. These cables are embedded in the panel fabric by being sandwiched between the panels and flaps welded thereto, wherein the catenary arched cables are formed in the confronting edges of the panels. It is important that the design of these arches be such that all horizontal stresses on the membrane itself are applied equally and oppositely, to uniformly distribute the stress loads within the membrane formed by the panels.

In greater detail, FIG. 5 shows two panels 42*a*, 44*a* in edge-to-edge confrontation. Steel cables 80, 82, which are similar to the cables 46, 48 described in connection with FIGS. 3 and 4, are laid out adjacent the edges of the panels and are sealed in place as a series of confronting arches to form catenary cables. These cables are sealed in place by flaps 88, 90 which are cemented, welded or otherwise attached over the edge of the panels to form pockets containing the cables. Periodically (such as every 18 inches) scallops or apertures or apparatus 96, 98 are cut out at the points where the cables 87, 89 come together in face-to-face confrontation.

In the open areas of the scallops or apertures 96, 98, suitable connector means 100, such as links, shackles, staples or cable ties may be used to secure the panels together. These connectors 100 are substantially the same as connectors 62 of FIGS. 3 and 4. The flaps 102, 104 contain and provide the zipper connection 106. The zipper flaps 102, 104 are welded or cemented to panels 42*a*, 44*a* outside of the flaps 88, 90 so that the closed zipper will completely cover the cables exposed in scallops 96, 98, the connectors 100, and the cable pockets formed by cementing the flaps 88, 90 to the panels 42*a*, 44*a*.

The airtight, watertight panel flaps with the plastic zipper or slide closure can either overlie or underlie the cable connection or structural seam depending on the particular need. For example, if the fabric panels are seamed together in a dome shape for use as a cover for a fermentation pond, the airtight panels might be under the cables 46, 48 which mechanically support them to prevent them from being blown open by the entrapped and pressurized gas produced by fermentation. However, if the fabric is used as a liner for a football field or a waste collection pit, it may be desirable to have the watertight panels above the cables to be supported against the weight of the water acting downwardly against them. Of course, the flaps 64, 66 are properly positioned for the needs of any given location and installation needs. In any event, the inventive seam creates structurally sound panels having connections which prevent or restrain water and air from escaping through the seams.

When the inventive seam is utilized to join panels, the seams should preferably have at least the same strength as the parent fabric or material. Since the cable connection offers strength to the seam, the airtight slide closure connection is less likely to fail due to stress.

Under some circumstances, where mechanical strength is not important to any particular installation, either the cables or loop connectors can be eliminated from the panels. For example, if it is necessary to quickly cover or uncover a baseball field, where almost no mechanical stress is placed upon the seam, the danger of a mechanical failure is less than the danger of a slow covering of the field. Therefore, the inventive seam can be modified and tailored for a particular use.

There are many advantages to the airtight, watertight mechanical seam. First, the seam is easy to set up and connect in the field under numerous environmental conditions. Second, the seam saves man-hours and helps cut down the cost of intalling a fabric liner or cover. Third, the seam is less likely to fail due to stress. Fourth, the seam is standardized and not subject to error by an inexperienced crew in the field, since the critical welds are made in the factory. Fifth, the seam is flexible, can be employed in a variety of different uses, and can be made stronger or weaker depending upon user needs. Sixth, the mechanical seam allows installation in cold climates. Presently liners can usually only be installed from March through October in the northern half of the United States Of course, the seams are not limited to outdoor use they may be used any time that air and watertight connections are required.

Those who are skilled in the art will readily perceive how to modify the invention. Therefore, the appended claims are to be construed to cover all equivalent structures which fall within the true scope and spirit of the invention.

I claim:

1. A two-step method of manufacturing large scale membranes for covering extremely large areas, the method comprises:

step one, in a factory:

(1) making a plurality of panels of industrial strength fabric which are shaped and proportioned to be fitted together to make said membrane;

(2) reinforcing the edges of said panels at least in the area where said panels confront each other when fitted together;

(3) forming a plurality of non-contiguous spaced apart areas in association with said reinforced edges, said spaced apart areas being at locations where said panels may be mechanically joined to each other;

(4) bonding a plastic slide closure means to each of said panels at a location which is parallel to said edges, said bonding to said panel enabling said slide closure to complete a waterproof surface between said panels and across said edges including said spaced apart areas;

(5) shipping said panels to an installation site;

step two, in the field at said installation site:

(6) laying out said panels in the form of said membrane;

(7) mechanically joining said panels to each other by adding mechanical couplings at each of said spaced apart areas; and (8) closing said plastic slide closure means to form said waterproof surface across a seam in said membrane which is formed by said mechanical couplings.

2. The two-step method of claim 1 wherein said reinforcing step further comprises the step of folding an edge of said membrane over a steel cable and bonding said folded edge onto said membrane.

3. The two-step method of claim 2 wherein said mechanical joining step comprises fastening together said cables in said confronting edges at each of said spaced apart areas.

4. The two-step method of claim 2 wherein said spaced apart areas are apertures in and at said folded edges, said cables passing through said apertures, and said mechanical joining of step (7) comprising the step of placing shackles over said cables in said apertures at confronting edges of a pair of said panels.

5. A two-step method of manufacturing large scale membranes for covering extremely large areas, the method comprising:

step one, in a factory:

(1) making a plurality of panels of industrial strength fabric which are shaped and proportioned to be fitted together to make said membrane;

(2) reinforcing the edges of said panels at least in the area where said panels confront each other when fitted together;

(3) bonding a plastic slide closure means to each of said panels at a location which is parallel to said edge, said bonding to said panel enabling said slide closure to complete a waterproof surface between said panels and across aid edges;

(4) shipping said panels to an installation site;

step two, in the field at said installation site;

(5) laying out said panels in the form of said membrane;

(6) closing said plastic slide closure means to form said waterproof surface across a seam in said membrane; and (7) adding means for reinforcing the mechanical joining of said panels substantially near said reinforced edge.

6. A two-step method of manufacturing large scale membranes for covering extremely large areas, the method comprising:

step one, in a factory:

(1) making a plurality of panels of industrial strength fabric which are shaped and proportioned to be fitted together to make said membrane;

(2) forming a reinforced edge on each of said panels in areas where said panels will confront each other and will be joined to each other when fitted together in the field;

(3) bonding a plastic slide closure to each of said panels along the length of aid reinforced edge to enable said slide closure to complete a waterproof surface between said panels;

(4) shipping said panels to an installation site;

step two, in the field at said installation site;

(5) laying out said panels in the form of said membrane;

(6) preparing said confronting edges for adding mechanical strength to said membrane; and (7) closing said plastic slide closure means to form said waterproof surface across a seam in said membrane with said added mechanical strength.

* * * * *